United States Patent [19]

Weir et al.

[11] Patent Number: 4,970,954

[45] Date of Patent: Nov. 20, 1990

[54] SELF INKING HAND STAMP

[75] Inventors: David A. Weir, Solvang, Calif.; Richard E. Hewitt, 140 La Verse Rd., Santa Barbara, Calif. 93108

[73] Assignee: Richard E. Hewitt, Santa Barbara, Calif.

[21] Appl. No.: 462,724

[22] Filed: Jan. 9, 1990

[51] Int. Cl.[5] ..... B41K 1/42

[52] U.S. Cl. ..... 101/334; 101/104

[58] Field of Search ..... 101/333, 334, 104, 105, 101/35, 41, 42

[56] References Cited

U.S. PATENT DOCUMENTS 3,364,856 11/1965 Lind ..... 101/334

4,432,281 2/1984 Wall et al. ..... 101/334

*Primary Examiner*—David A. Wiecking

*Assistant Examiner*—C. A. Bennett

*Attorney, Agent, or Firm*—Marvin E. Jacobs

[57] ABSTRACT

A hand operated stamp with two slidable housings, one inside the other, adapted to compress springs when slid together and also to rotate a stamp die from an ink pad contacting position inside the inner housing to an imprint positioin at the bottom of the inner housing. The compression springs are attached to and removable with a cap on the outer housing to save space and allow easy replacement of the ink pad.

5 Claims, 2 Drawing Sheets

Fig. 2
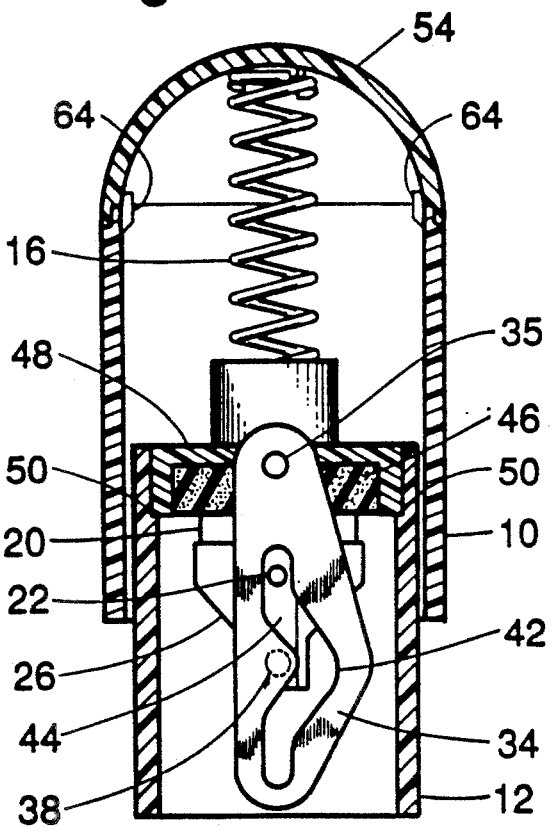
Fig. 3
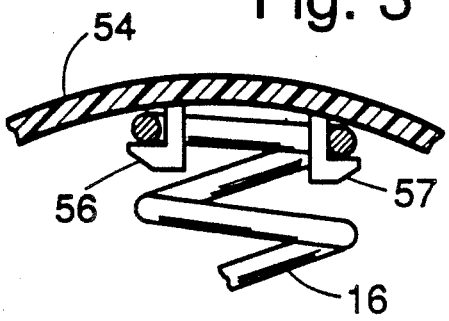
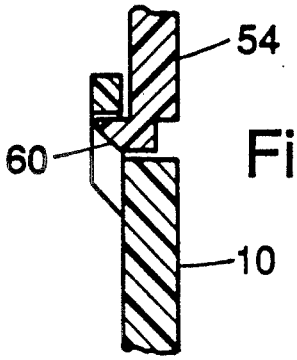
Fig. 4
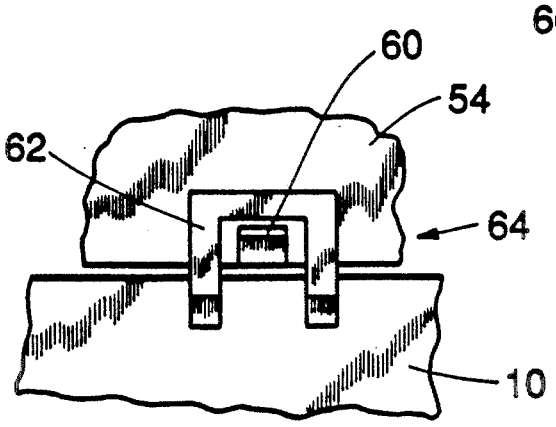
Fig. 5

SELF INKING HAND STAMP

TECHNICAL FIELD

This invention relates to hand stamping devices for making ink impressions on documents, boxes or other surfaces where the printing die automatically moves from a position against an ink pad to a printing position when the stamp is pressed downward on to the surface to be imprinted. More specifically, a stamper is disclosed that can be more compact and which affords easy mess-free removal of the ink pad when replacement becomes necessary.

BACKGROUND OF THE INVENTION

Self-inking stamps are known in the prior art that operate by pressing an outer housing downward so it slides down and around an inner housing. The inner housing contains a rotatable printing die that moves from a rest position against an ink pad to an imprint position in response to the relative movement of the inner and outer housings. The inner and outer housing are spring biased apart so as to hold the die normally against the ink pad when the stamp is not being compressed. Such a device is typified by the disclosure in U.S. Pat. No. 4,432,281 and the references cited therein. In this prior art patent, the outer housing includes a metal bridge that spans the housing and against which are mounted the springs that engage and bias the inner housing towards a rest position. Since the ink pad occupies essentially all of the width the inner housing, the bias springs necessarily rest against the ink pad itself. As a result, when the pad must be reinked, a rather cumbersome procedure is necessitated in which a cap on the outer housing is removed to expose the metal bridge. The hand stamp is then compressed, and held that way, so as to bring the ink pad closer to the metal bridge whereby ink can be dispensed through holes in the bridge, and actually through the centers of the spring, into ink wells that communicate via small holes with actual ink pad. A slight misjudgment by the user can create messy ink spills throughout the complicated mechanism. Worse yet, if the compressed stamper is accidentally released, ink may splatter everywhere. A more efficient, easier to use, cleaner, and more compact design is contemplated by the present invention.

SUMMARY OF THE INVENTION

In brief, the instant invention provides an improved design that avoids the need to introduce fluid ink into the hand stamper. A removable ink pad containing box is employed which when exhausted may be removed totally and replaced with a fresh ink pad box. There is no need to pour ink into the hand stamper itself. Another improvement in design is that the bias springs are mounted directly to the outer housing cap so that when the cap is removed, the springs go with it, thus exposing the removable ink pad box for easy removal. Special mounts are provided between the spring and cap, and also between the cap and outer housing so that the cap can be conveniently snapped on and off the housing and still contain the bias spring forces which forces are communicated from the inner housing to the outer housing by means of the cap alone. Springs mounted in this way make use of the full internal space in the outer housing, extending from the ink pad box all the way to the cap so as to provide additional synergistic benefits in the form of longer springs and more compact housings.

Longer springs give smoother spring action and a more even and repeatable pressure of the printing die on the ink pad. The quality of the printed image is dependent on the correct pressure of the die on the ink pad. A more compact structure is desirable to save on materials and when smaller stampers are desired.

Hence, a stamper is provided that has less parts, eliminating a metal spring supporting bridge, and which is cleaner in use, more compact, and more reliable. Providing fresh ink pads is easier, faster, and less messy than in the prior art. Additional advantages, features, and improvements will become apparent upon consideration of the following detailed description and drawings.

BRIEF DESCRIPTION OF THE DRAWINGS

FIG. 2 is also a cross-sectional elevational view of the stamp, but taken from the side view relative to FIG. 1.

FIG. 3 is a fragmentary detail view of the area of the cap where the bias springs are attached so as to be removable with the cap.

FIGS. 4 and 5 show, respectively, two orthogonal views of a typical latch or mount to secure the cap to the outer housing and resist spring bias forces.

DETAILED DESCRIPTION OF THE INVENTION

Figure 1:
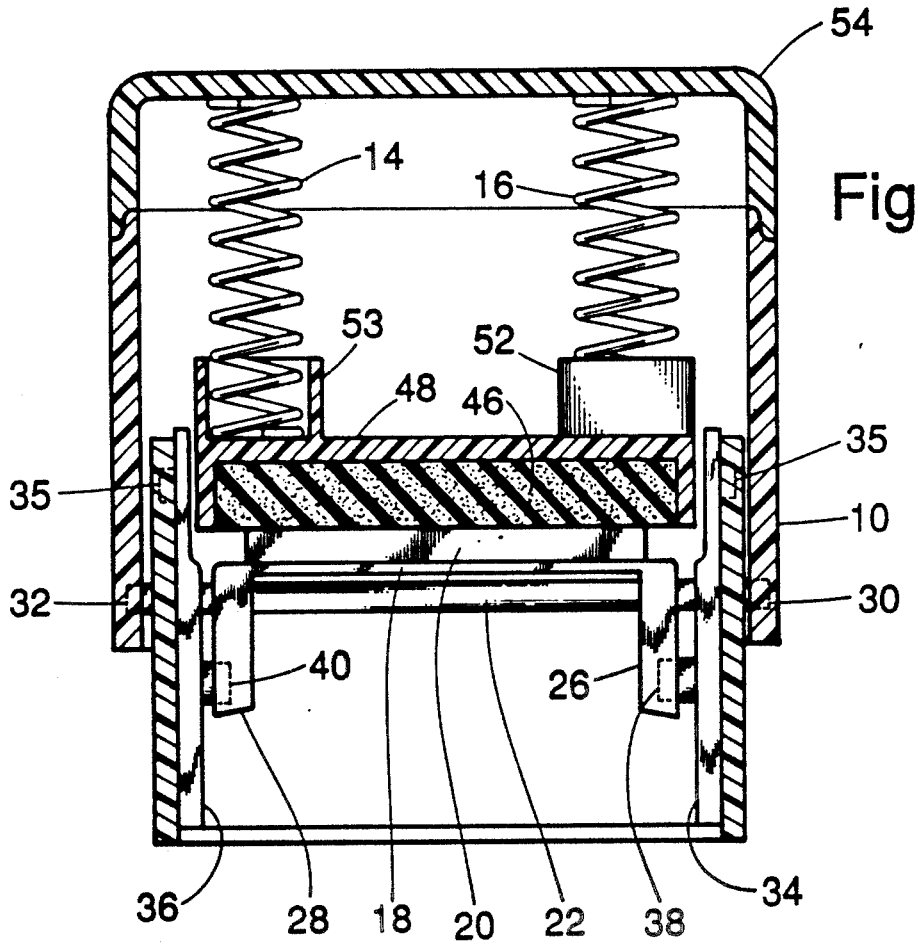
FIG. 1 is a cross-sectional elevational view of the hand stamp of the present invention showing &:he essential operating components and the relationship of the inner and outer housings.
Figure 6:
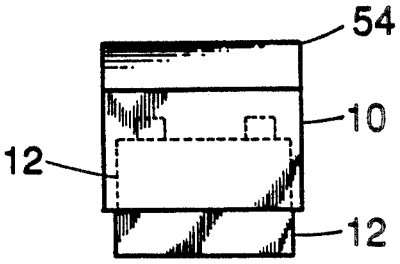
FIG. 6 shows the hand stamper with the inner housing in the extended rest position as assumed when the bias springs are fully extended.

In FIG. 1, an outer housing 10 is shown which surrounds and partially contains within it a vertically slidable inner housing 12. As can be seen in FIG. 6, both housings comprise generally rectangular and hollow members, open at the bottom, and similar in size. In use, the outer housing 10 is grasped with the hand and pressed downward pushing the open lower end of inner housing 12 against the surface to be imprinted. This causes inner housing 12 to slide upward inside housing 10, against the action of a pair of biasing springs 14 and 16, and also causes a rotary die pad 18, and a die 20 mounted thereon, to both move downward relative &.o inner housing 12 and to rotate during that downward movement. This happens because die pad 18 is pivotally mounted about an axle 22 by means of two downwardly extending guides 26 and 28 through which axle 22 passes. Since axle 22 is mounted at its ends in holes 30 and 32 in outer housing 10, it moves downward with housing 10 and carries die pad 18 downward inside housing 12 as well. Slots in housing 12 allow the downward slide of axle 22.

The rotary motion of die pad 18 is induced by a pair of slotted guide plates 34 and 36 which have pins 38 and 40 about which guides 26 and 28 pivot. The slotted guide plates themselves can swing about two other pins 35 which engage housing 12. As is perhaps more apparent in FIG. 2, the slotted guide plates 34 and 36 both contain a curved slot 42. In addition, guides 26 and 28 both contain a groove 44 that engages pins 38 and 40.

As axle 22 moves downward, it slides along curved slots 42 causing guides 26 and 28, and the attached die 20, to rotate about pins 38 and 40 so as to bring die 20 through a half turn whereby it emerges from the open lower end of inner housing 12 and imprints the surface upon which housing 12 is resting. This downward rotary movement of the impression die is similar to mechanisms in the art and not of particular concern in the instant disclosure.

When the bias springs are extended fully, with outer housing 10 toward the top of inner housing 12, die pad 20 normally rests against an ink pad 46. In accordance with the principles of this invention, ink pad 46 in contained in a removable ink pad box 48 that snaps in by a friction fit onto ledges 50 in housing 12. A pair of spring retaining cups 52 and 53 are formed on the top of ink pad box 48 to locate and axially restrain bias springs 14 and 16. Cup 53 is shown in section in FIG. 1.

Figure 7:
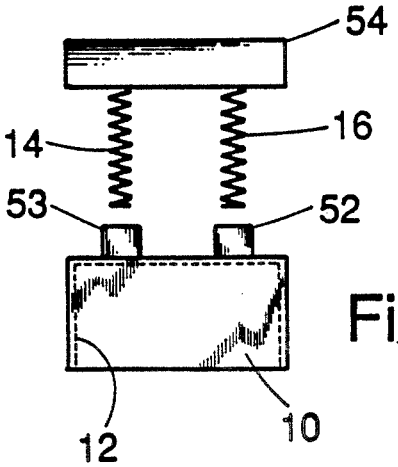
FIG. 7 shows how the cap and bias springs may be detached as a unit and the inner housing positioned to permit easy and clean removal of the replaceable ink pad box.

Housing 10 includes a snap-on cap 54 to which the upper ends of springs 14 and 16 are firmly attached. FIG. 3 shows a possible attaching structure wherein lugs 56 and 57 extend through the center and under the upper portions of the bias springs. Hence, when cap 54 is removed, as shown in FIG. 7, the springs 14 and 16 are removed with it. Removable ink pad 48 may now be easily snapped out and replaced. Spring cups 53 and 52 afford convenient gripping surfaces to facilitate this replacement. The whole ink pad may be discarded and a new one inserted with no messy ink bottles to handle, and no obstructing bias spring mechanism to block the way.

With this arrangement, the spring forces acting to push housing 10 upward relative to housing 12 are conveyed through cap 54. In order to insure that cap 54 remains in place, fairly reliable mounts should be used. FIG. 4 and 5 show suitable mounting structures wherein a hook shaped lug 60 on cap 54 snaps under and engages a strap or loop 62 formed as a part of housing 10. The combination of this lug and strap comprises a mount assembly 64 shown only schematically in FIG. 2. Four such assemblies 64 are contemplated in the preferred embodiment, although, of course, many variations are possible.

The majority of parts in this invention, except for the axle and springs, are formed from plastic in the preferred embodiment. The natural elasticity of plastic facilitates the snap action of mount assemblies 64 and spring retainers 56 and 57. With springs 14 and 16 connected to cap 54, the full internal space of both housing 10 and cap 54 is available to house longer, smoother operating springs. Also, the overall height of cap 54 and housing can be reduced if desired. And springs 14 and 16 do not interfere with the replacement of ink pad box 48. The specific structural details, however, should not limit the scope and spirit of the invention and thus the invention should be defined in accordance only with the appended claims.

We claim:

1. A self-inking hand stamp comprising:

a first, oblong, generally rectangular housing having a removable cap at one end;

a second, oblong, generally rectangular housing slidably disposed within said first housing, said second housing containing a replaceable, generally rectangular ink pad at the end nearest said one end thereof;

rotary die pad means in said second housing adapted to move from a rest position against said ink pad to an imprint position in response to the sliding of said first housing relative to said second housing; and a plurality of springs between said ink pad and said removable cap so as to urge apart said first and second housings and so as to normally hold said rotary die pad in said rest position, each of said springs being substantially smaller than the inside dimensions of said first housing and each of said springs located in position at one end by being attached to said cap and located at the other end by retaining means on said ink pad, the attachment of said springs to the cap allowing the removal of the springs with the cap.

2. The stamp of claim 1 in which said replaceable ink pad rests in a friction fit with the second housing upon ledges in said second housing so as to transfer the force of said springs into said second housing.

3. The stamp of claim 1 including mount assemblies between said removable cap and said first housing, said assemblies being flexible enough to permit the cap to be snapped on and off the first housing and said assemblies being resistant to being released by the spring forces from said springs.

4. The stamp of claim 3 in which said ink pad rests in a friction fit with the second housing upon ledges in said second housing so as to transfer the force of said springs into said second housing.

5. The stamp of claim 4 in which said plurality of springs comprises two springs.

* * * * *